United States Patent [19]

Folk

[11] 4,351,110

[45] Sep. 28, 1982

[54] APPARATUS FOR TERMINATING RIBBON CABLE

[75] Inventor: Kenneth F. Folk, Harrisburg, Pa.

[73] Assignee: AMP Incorporated, Harrisburg, Pa.

[21] Appl. No.: 81,409

[22] Filed: Oct. 3, 1979

[51] Int. Cl.[3] ..... H01R 43/04

[52] U.S. Cl. ..... 29/749; 29/753; 29/861

[58] Field of Search ..... 29/749, 751, 753, 759, 29/566.3, 566.4, 861

[56] References Cited

U.S. PATENT DOCUMENTS

| | | | |
|---|---|---|---|
| 3,953,925 | 5/1976 | Wilson | 29/749 |
| 4,017,954 | 4/1977 | Grubb | 29/749 |
| 4,068,912 | 1/1978 | Hudson, Jr. et al. | 339/99 R |
| 4,077,695 | 3/1978 | Bakermans | 29/749 X |
| 4,125,137 | 11/1978 | Shatto, Jr. | 29/749 X |
| 4,275,495 | 6/1981 | Boutcher, Jr. et al. | 29/749 |

*Primary Examiner*—Carl E. Hall

*Attorney, Agent, or Firm*—F. Brice Faller

[57] ABSTRACT

An apparatus for programming conductors in a flat ribbon cable into two parallel planes and terminating the conductors in a two-sided connector is disclosed. The apparatus while manually operated is adaptable to semi-automatic operation.

4 Claims, 18 Drawing Figures

APPARATUS FOR TERMINATING RIBBON CABLE

BACKGROUND OF THE INVENTION

1. The Field Of The Invention

The disclosed apparatus generally resides in the field of multi-conductor terminating apparatus and particularly in the field of ribbon cable termination. Ribbon cable has found wide spread uses in the industrial, telecommunication, and computer fields. However, the termination of the single plane parallel conductors to a two-sided connector has presented a cable handling problem which has troubled end users of ribbon cable.

2. The Prior Art

Prior art approaches to terminating ribbon cable include terminating the conductors with insulation displacement connectors driven in from above and below, wiping the conductor into the desired arrangement as a part of a conductor preparation step and terminating the conductors in a connector having staggered terminals. However, none of the prior art approaches have resulted in an efficient system for terminating ribbon cable in a two-sided connector having parallel terminals on a modified centerline.

SUMMARY OF THE INVENTION

The disclosed apparatus comprises a carriage mounted conductor programming station, a conductor wiping probe and a termination station. The conductor programming station is presented pre-split ribbon. The free end conductors are combed into upper and lower planes by an active comb and into the lead edge of programming templates. The programming station is then moved along a modified "Z"-shaped cam track which in the first leg thereof moves the conductors over the conductor wiping probe. During the movement through the midsection of the cam, the conductors are wiped into the template by the wiping probe. The template has complementary modified centerlines which realign the conductors on new centerlines. As the carriage moves through the second leg of the cam the conductors are presented over a connector holder which is affixed to the conductor wiping probe. Termination of the conductor is accomplished by opposed tooling which is driven by barrel cams mounted on opposite ends of a fixed shaft.

It is an object of this invention to provide a single apparatus for cable programming and terminating.

It is an object of the invention to provide an apparatus which may be semi-automatic or manually operated.

It is an object of the invention to provide a simplified conductor programming arrangement.

DESCRIPTION OF THE PREFERRED EMBODIMENT

The apparatus of the instant invention is primarily intended for the termination of ribbon cable to a two-sided insulation displacement type connector. Ribbon cable is familiar to those in the art and is a generic name for a type of cable having a plurality of conductors located in a parallel side-by-side arrangement in a flat singular plane conductor bundle.

Figure 1:
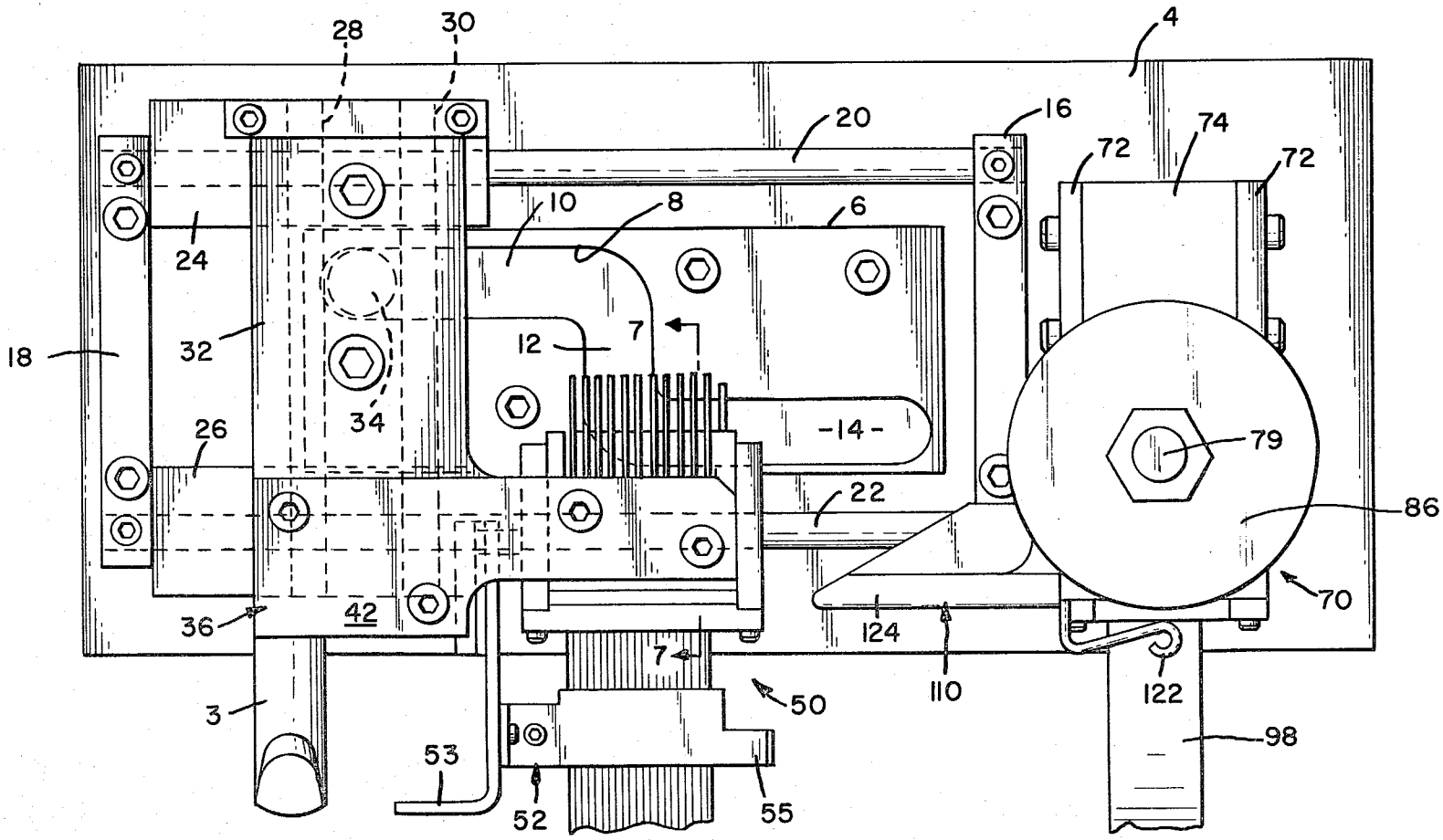
FIG. 1 is a top plan view of the apparatus.

Referring now to FIG. 1, the apparatus of the instant invention is generally designated as 2. The apparatus has a base 4 which is a generally rectangular mounting plate which may be located on a bench or similar working surface. Located on rectangular base 4 is a rectangular cam plate 6. The cam plate 6 is also generally rectangular in shape and is mounted in a parallel relationship to the base 4. Cam plate 6 has a modified Z-shaped cam track 8 having a first leg 10, a generally perpendicular midsection 12, and a second leg 14. The resultant shape of the cam track 8 then is that of a generally elongated Z. The configuration of Z cam 8 is controlled generally by the distance through which the conductors must be moved to effect conductor location and the particular arrangement of a conductor carrying means to a conductor terminating means. The selection of the shape of the Z cam will become more obvious as the explanation herein is given. The base 4 has two mounting blocks, 16 and 18, respectively, which are mounted parallel to the short end of the rectangular cam plate 6. The mounting blocks 16 and 18 are simply metal parts which are used to space the guide rails 20 and 22 in a parallel relationship to the length of the rectangular cam plate 6 and to maintain the rails 20 and 22 at some distance off of the rectangular base 4. The rails 20 and 22 are affixed in parallel relationship to the mounting blocks 16 and 18. Parallel guide blocks 24 and 26 are mounted on guide rails 20 and 22, respectively. Each guide block is generally a rectangular block of metal which has a bearing surface in the center thereof so that it may ride smoothly along the rail 20 or 22. The guide blocks 24 and 26 will move in a parallel relationship to cam plate 6. Parallel rails 28 and 30 are mounted between the guide blocks 24 and 26 in a perpendicular relationship to the guide rails 20 and 22. A carriage plate 32 is slidably mounted on guide rails 28 and 30. A cam follower 34 is mounted on the lower side of carriage plate 32 and extends down and into the cam track 8. A carriage block generally designated as 36 is mounted on carriage plate 32. The function of the carriage block 36 will be described more fully hereinafter.

At this time it can be seen that movement of a carriage plate 32 via handle 3 in a generally rightward direction will cause the guide blocks 24 or 26 to move along rails 20 and 22. The cam follower 34 will follow through the first leg 10 until it reaches the generally perpendicular midsection 12. At this point, the guide blocks 24 and 26 will become much slower in their movement and the carriage plate 32 will then move down the midsection along the rails 28 and 30. At the end of midsection 12 the carriage plate will then again proceed in a generally rightward direction through the second leg 14. This movement will cause the conductor control station generally designated as 50 which is mounted in the carriage block 36 to be first moved rightwardly and then outwardly so as to cause wiping of the conductors and to establish control over the conductors located within the control station 50. The end results will be the movement of the conductors into the joint wiping and termination station, generally designated as 70.

Figure 2:
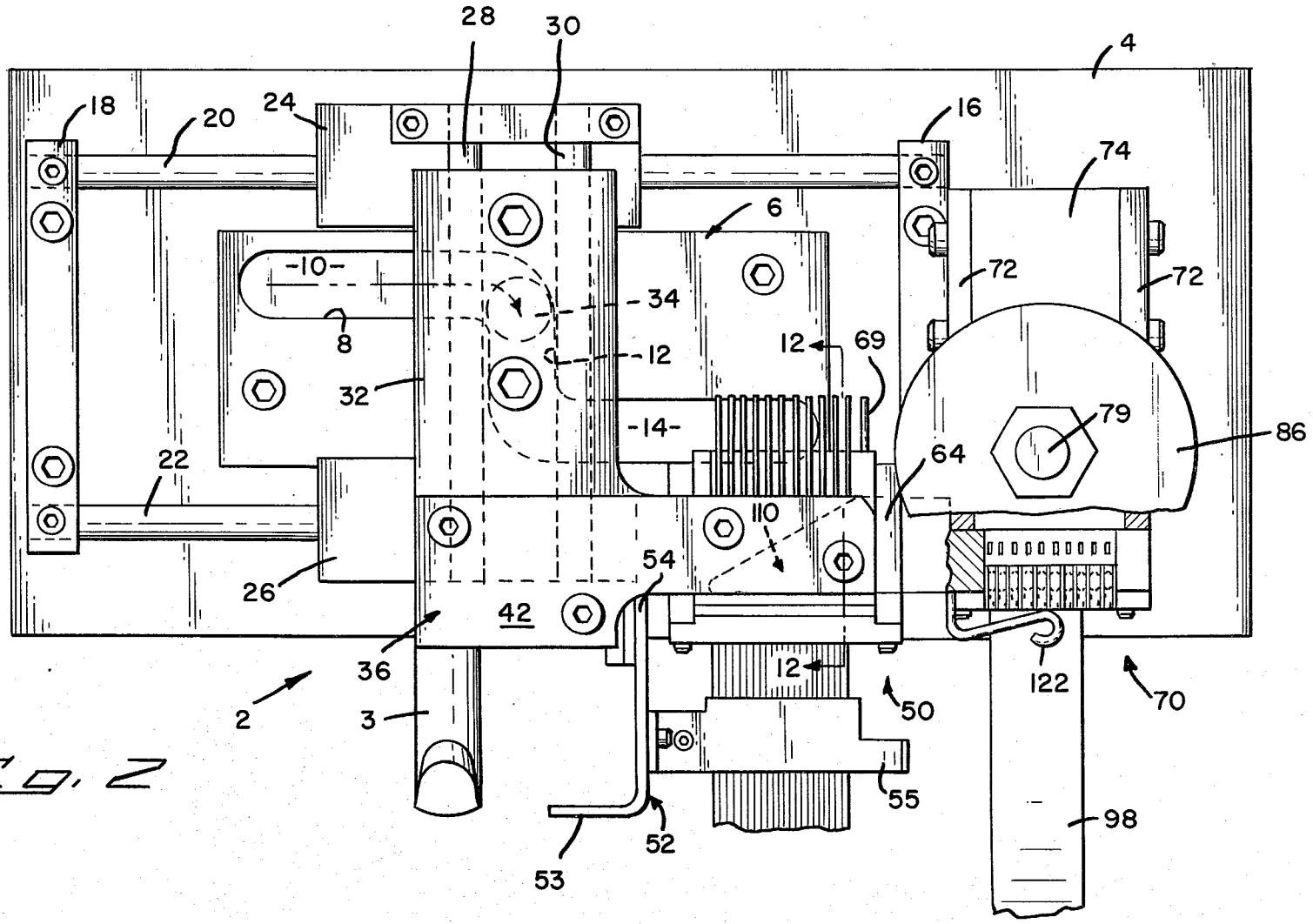
FIG. 2 is a top plan view of the apparatus showing rightward movement. The connector holding position is sectioned for ease of understanding.
Figure 3:
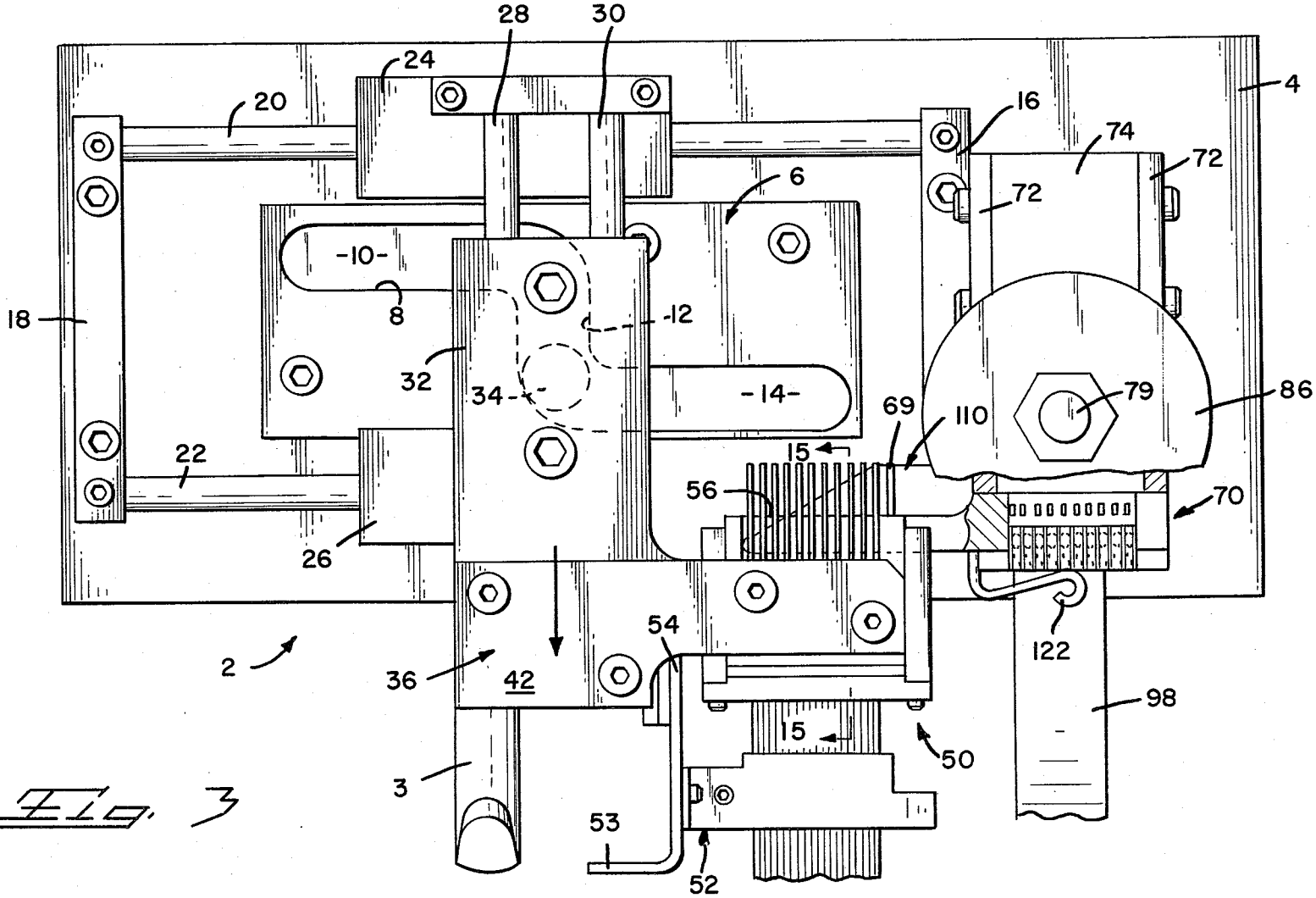
FIG. 3 is the apparatus of FIG. 2 moved forward.
Figure 4:
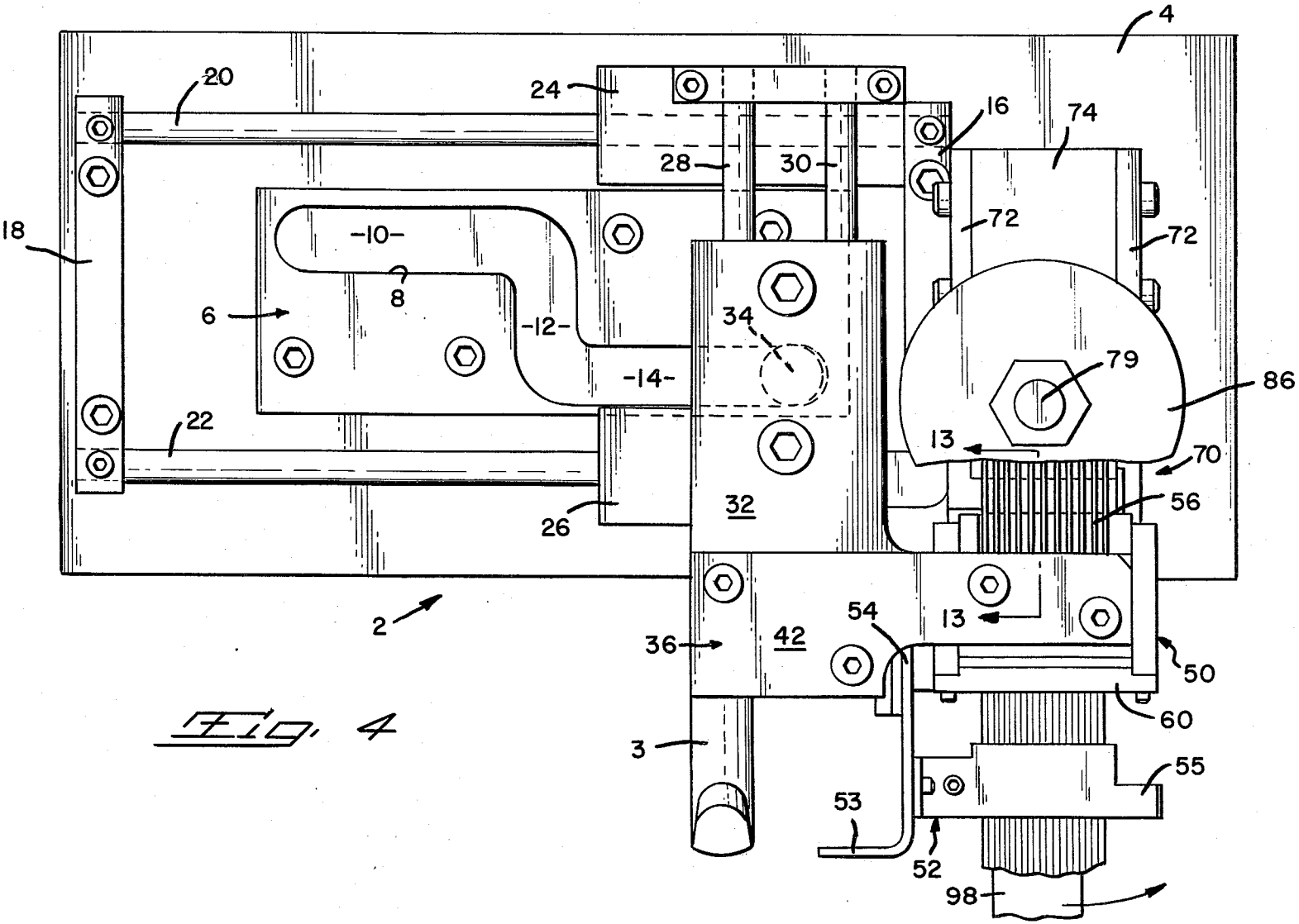
FIG. 4 is the apparatus of FIG. 3 moved to its rightward rest.

This motion may be seen more clearly by reference in FIG. 2. FIG. 2 shows the cam follower 34 as it approaches the midsection and the conductor control station. FIG. 3 shows the cam follower 34 as it passes over the wiping portion of the Z-shaped cam track 8. In FIG. 4 it is possible to see that the cam follower 34 is now moved through the second leg 14 of cam track 8 and has positioned the conductors in termination station 70.

Figures 5, 5A:
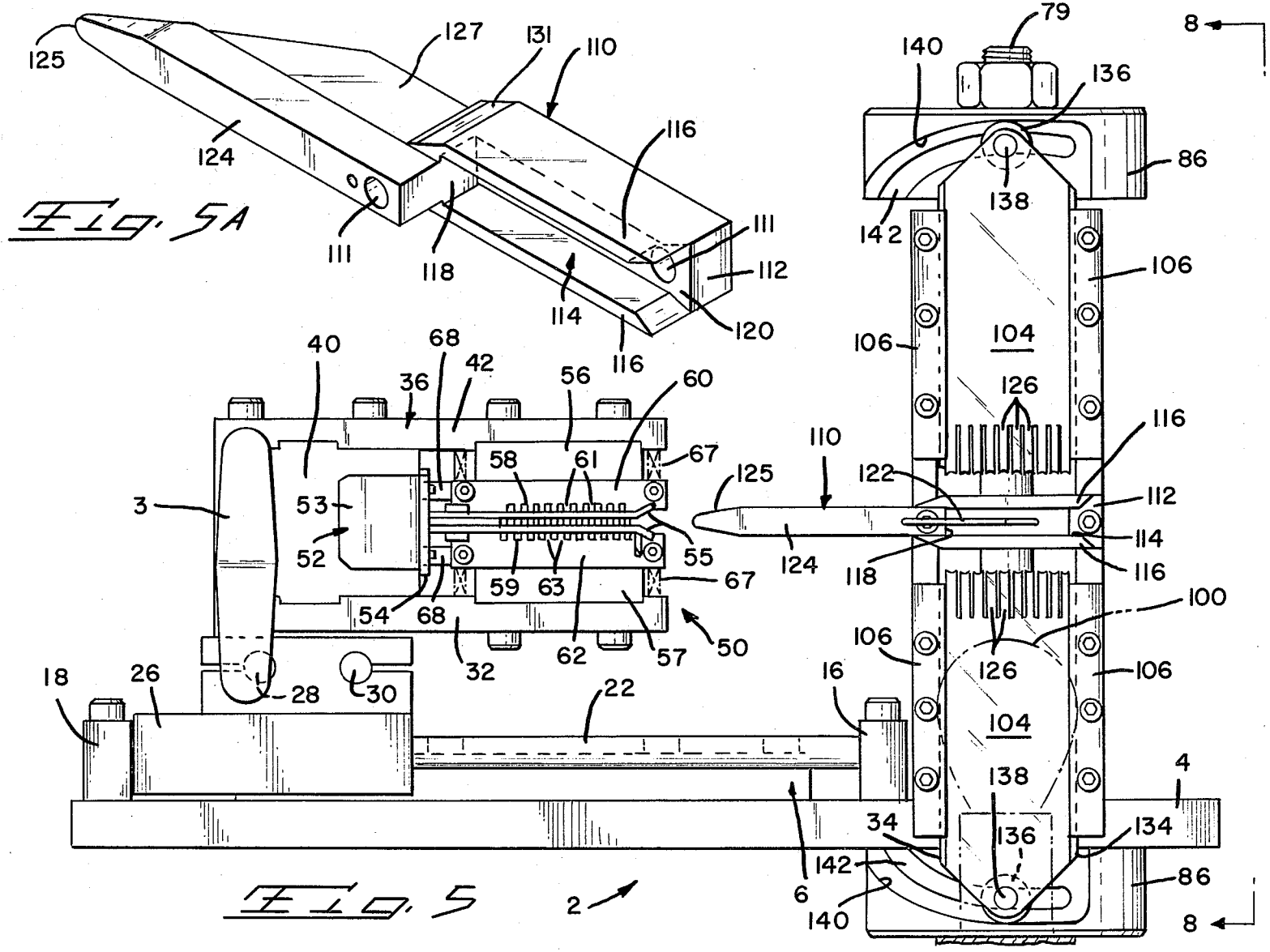
FIG. 5 is a front elevation view of the apparatus of FIG. 1.
FIG. 5A is an exploded perspective view of the wiping fixture of FIG. 5.

Referring now to FIG. 5, the carriage plate 32 forms the lower support member for the conductor control station. A spacer block 40 is mounted on carriage plate 32 and an upper plate 42 is affixed to the spacer block 40. It can be seen that the carriage plate 32 and the upper plate 42 extend from the block 40 in a cantilever fashion. Mounted between plate 32 and upper plate 42 is the conductor programming station generally designated as 50. A cable guide generally designated as 52 is slidably mounted on the spacer 40. A handle 53 is provided for pushing the cable guide 52 inward towards the spacer block 40. A spring is provided in the spacer block for biasing the cable guide 52 outwardly. The slide and spring are not shown as it is believed that these arrangements will be obvious to those skilled in the art.

The cable guide 52 includes a wedge cam member 54 which is positioned to separate comb members 60 and 62 as will be described in detail more fully hereinafter. The conductor control station comprises generally an upper template 56 and a lower template 57 which are fixed to the carriage plate 32 and the upper plate 42. The templates 56 and 57 have a plurality of conductor receiving grooves 58 and 59, respectively, for aligning the conductors in proper parallel relationship for termination. The initial control of the conductors is established by the use of the comb member 60 and 62. The upper comb 60 is pivotally mounted to template 56 via lever arms 64 and pin 66. The lever arms 64 are pinned to the block 56 and permit the comb to be moved in a vertical manner by the roller 68 following the wedge cam 54. Compression springs 67 are provided for downward biasing of the comb 62. Lower comb 63 incorporates a similar structure having lever arms 65 pivotally mounted via pins 66 to the lower template 57. Similar rollers 68 are provided for following the wedge cam 54. Compression springs 67 are provided for biasing the lower comb member 62 in an upward manner. Thus to insert a cable in the conductor control station the cable is first split to provide a plurality of separated condcutors at the free end of the cable. Handle 53 is pushed toward block 40 which causes the wedge cam 54 and the collaboration of rollers 68 to move the comb members 60 and 62 to an open position. The cable is then located between the fingers 55 in the cable slot there provided with the split portion of the cable forward of the comb members 60 and 62. The handle 53 is released and the spring biasing member causes the cable guide to be slid rearward which will cause the comb members 60 and 62 to move toward each other and force the conductors out of the plane of the cable.

Figure 6:
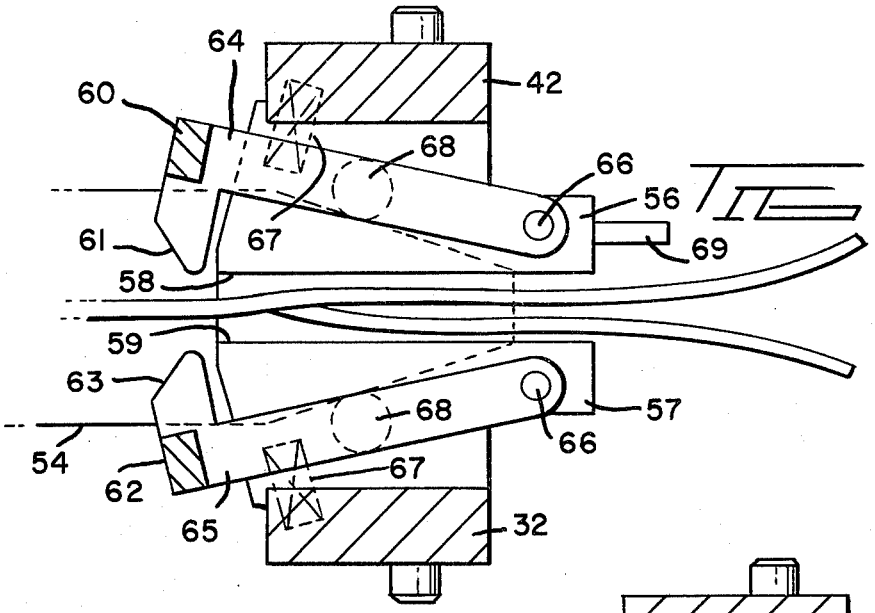
FIG. 6 is a diagrammatic view of the conductor programming station of FIG. 5.
Figure 7:
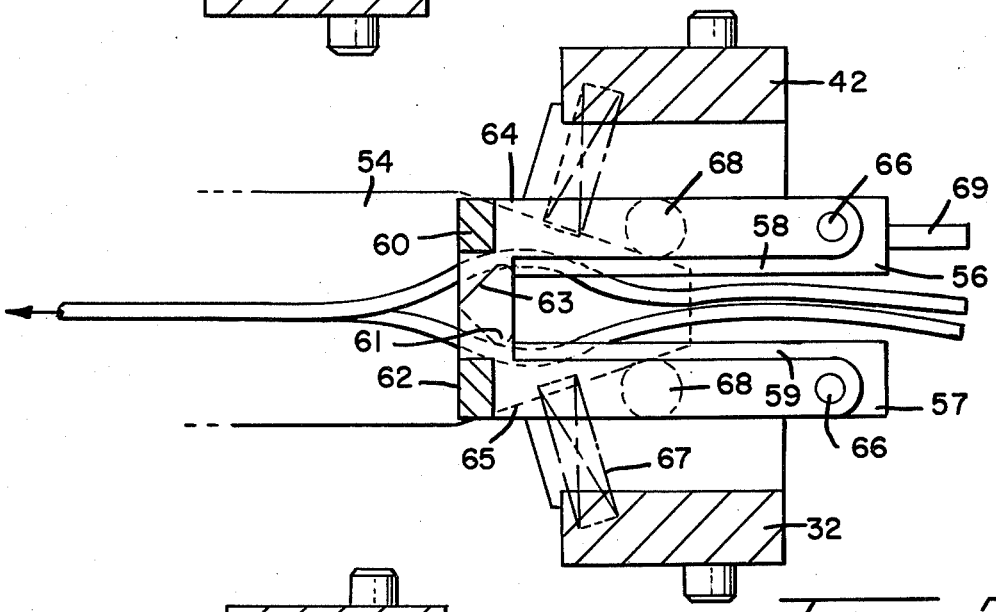
FIG. 7 is a diagrammatic view showing the station of FIG. 6 in a closed condition.

Referring now to FIG. 6, which is a diagrammatic exploded view of the conductor programming station 50, it is possible to more fully explain the operation of the conductor programmer. The wedge cam 54 is moved into the rollers 68 which open the comb members 60 and 62 about the pivot point of pins 66 via lever arms 64 and 65. A pre-split cable with free end conductors is moved into the free area and against handle 53 which acts as a cable stop, see FIG. 5. The handle 53 is then released and the wedge cam 54 biased outwardly and the comb members 60 and 62 close on the free conductors. Referring now to FIG. 7, it can be seen that as the offset teeth 61 and 63 of comb members 60 and 62 move past each other the conductors will be oppositely directed out of the plane of the cable. The cable is then drawn through the comb members until the free end thereof are aligned with the end of lengthening guide 69. The total length of the conductors from the comb area to the end of lengthening guide 69 is determined by the connector to be terminated and will vary according to the application. The function of the lengthening feature is to provide sufficient length for cutting and termination of the conductors. This will become obvious when the termination is described hereinafter.

Figure 8:
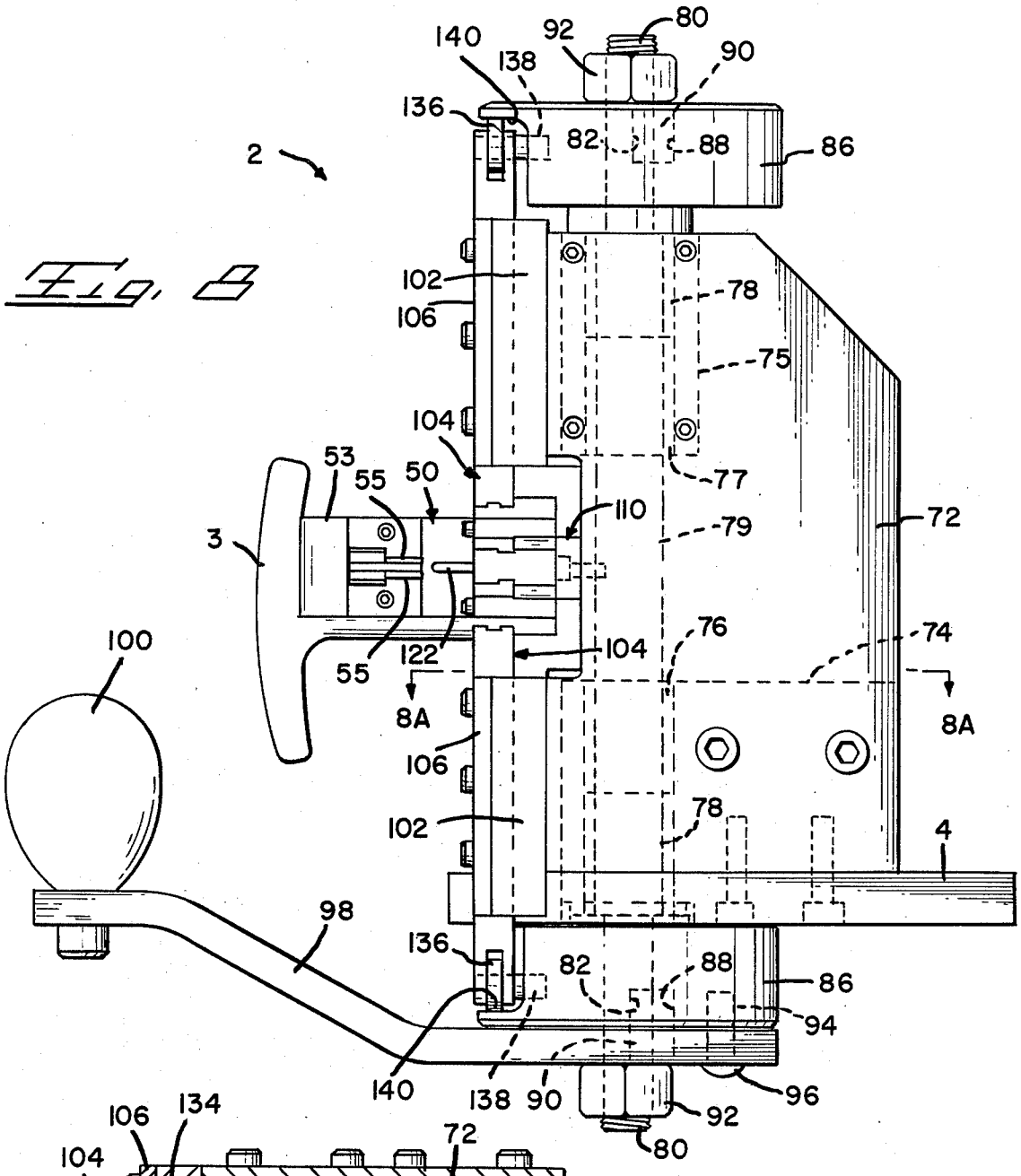
FIG. 8 is a side elevation view of the apparatus shown in FIG. 5.
Figure 8A:
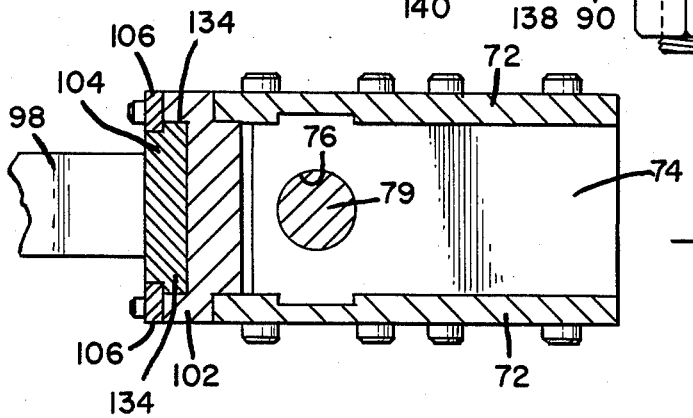
FIG. 8A is a section through the line 8A—8A of FIG. 8.

Referring now to FIGS. 5 and 8, wiping and termination station 70 will now be described. Spaced vertical plates 72 are mounted on base 4 via block 74 one end thereof and are secured to a spacer block 75 proximate the ends thereof. The bores 76 and 77 through blocks 74 and 75 respectively are on a common centerline. A collar bushing 78 is located in each of the bores 76 and 77. Shaft 79 extends through each of the collar bushings 78 and is threaded at 80 on either end. A keyway 82 has been cut at either end of shaft 79 just beyond threads 80. A barrel cam 86 having a keyway 88 is secured via key 90 to either end of shaft 79. On the upper end of shaft 79 a nut 92 secures barrel cam 86 against vertical movement. On the lower end of shaft 79 the barrel cam 86 has been tapped, as illustrated at 94, in three places to secure a handle lever 98 via screw 96. A nut 92 holds the assemble against vertical movement. Handle 100 is secured to handle lever 98. Thus movement of the handle will move shaft 79 and barrel cams 86 in unison. Since the tooling functions in unison in an opposed manner, the description will be limited to the lower tooling package. A "U"-shaped spacer 102 extends between the vertical plates 72 and provides one half of the track for tooling package 104 which is provided by a retainer plate 106 mounted on either side of the tooling package to spacer 102. This configuration may be clearly seen by reference to FIG. 8A.

Figure 9:
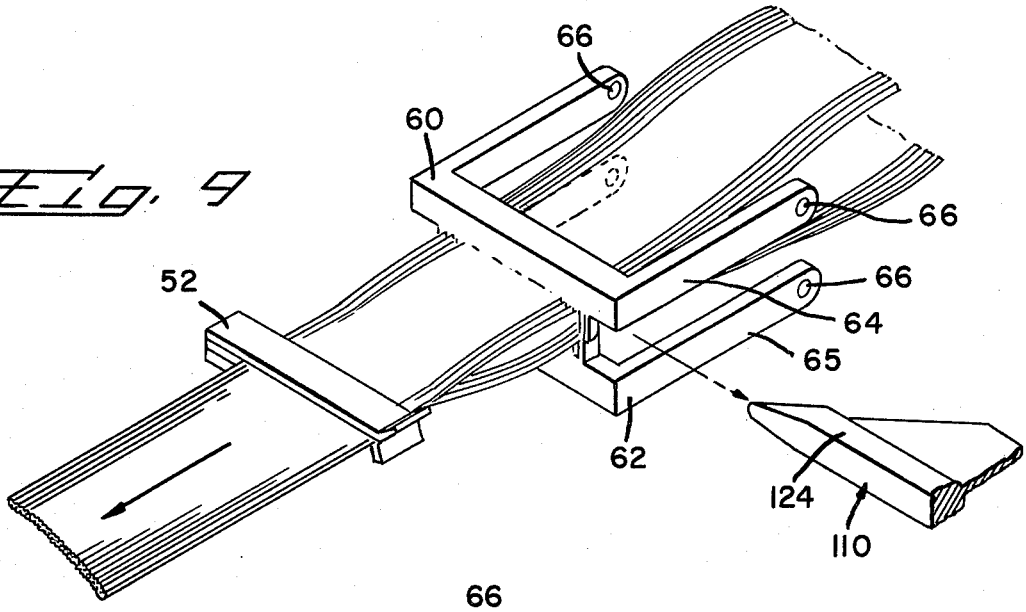
FIGS. 9–11 are diagrammatic views of the conductor programming station and fixture.
Figure 10:
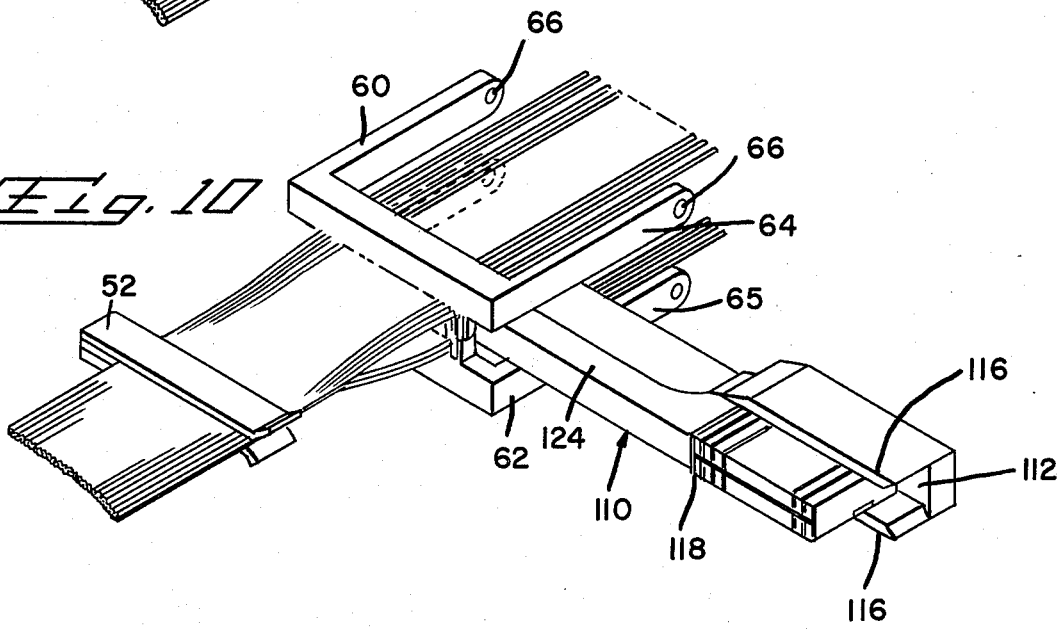
Figure 11:
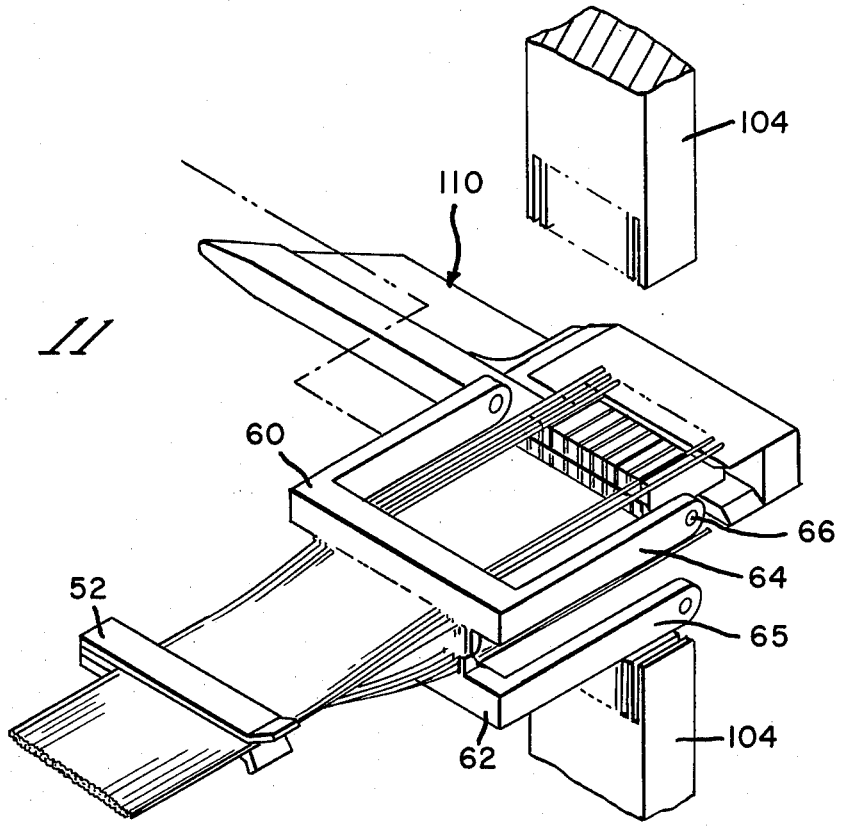

Referring again to FIGS. 5-5A, connector holding-conductor wiping fixture 110 is clearly shown bolted to vertical plates 72 by bolts passing through bores 111. The connector holding portion thereof 112 has a connector channel 114 formed by cutter bars 116. Obviously, the depth of channel 114 is connector related and may be varied, however, it can be seen that stop 118 is located to assure alignment of the tooling 104 and the conductor terminals. By reference to FIG. 8, it can be seen that the floor 120 is flat and that fastener bores 111 are recessed. A spring clip 122 is forced fitted to fixture 110 and secures the connector in place. Conductor wiping finger 124 has a tapered tip 125 which establishes the initial entry into the conductor programming station 50, the flat midsection 127 increases the contact with the conductors and wipes them into the conductor grooves 58 and 59 of templates 56 and 57 , respectively, and inclined surfaces 131 assure that the ends of the conductors are located over the cutter bars 116, see FIGS. 9-11.

A set of opposed tools 104 are positioned on either side of the fixture 110. The tooling 104 is a multi-purpose cutter, conductor inserter and strain relief crimping die. There is a tool blade 126 for each conductor. By reference to FIG. 13, it may be clearly seen that each blade 126 has a cutting edge 128 which cooperates with cutter bar 116, a conductor inserter 130 for inserting the conductors in the wire in slot area of the terminal and die 132 for crimping the strain relief.

Returning to FIGS. 5 and 8, the drive means for tooling 104 comprises a rail 134 on either side of tool 104 which travels in the track formed by spacer 102 and plate 106 as previously described.

At the opposite end of tool 104 from blades 126 is a cam follower 136 mounted on shaft 138 and tracking on barrel cam 86. Track 140 is cut in cam 86 to drive tooling 104 toward fixture 110. A groove 142 is cut parallel to and deeper than track 140. Referring to FIG. 8, shaft 138 is positioned in groove 142 as a positive tooling return feature. Thus during the work stroke the follower 136 will provide a smooth power transfer under load and during the unloaded return stroke shaft 138 will lift the tooling.

While the tooling package has been described in a manually operated apparatus, it will be obvious that a proximity switch may be used to sense the conductor position and to trip solenoid driven tooling. Additionally, it should be noted that in an automated operation it may be preferable to mount the solenoid operated wiping and termination station 70 on a movable carriage over a Z cam.

Figure 12:
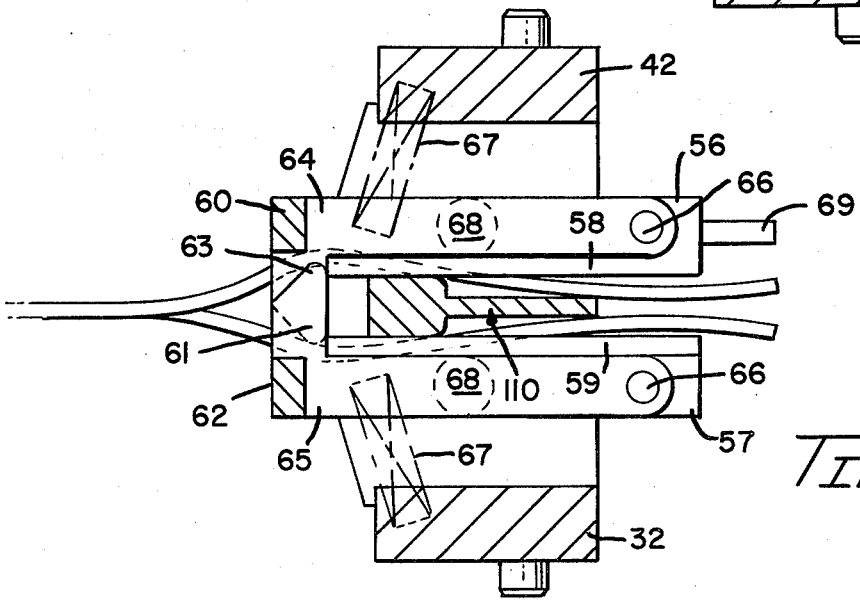
FIG. 12 is a section through the wiping fixture as shown in FIG. 10.
Figure 13:
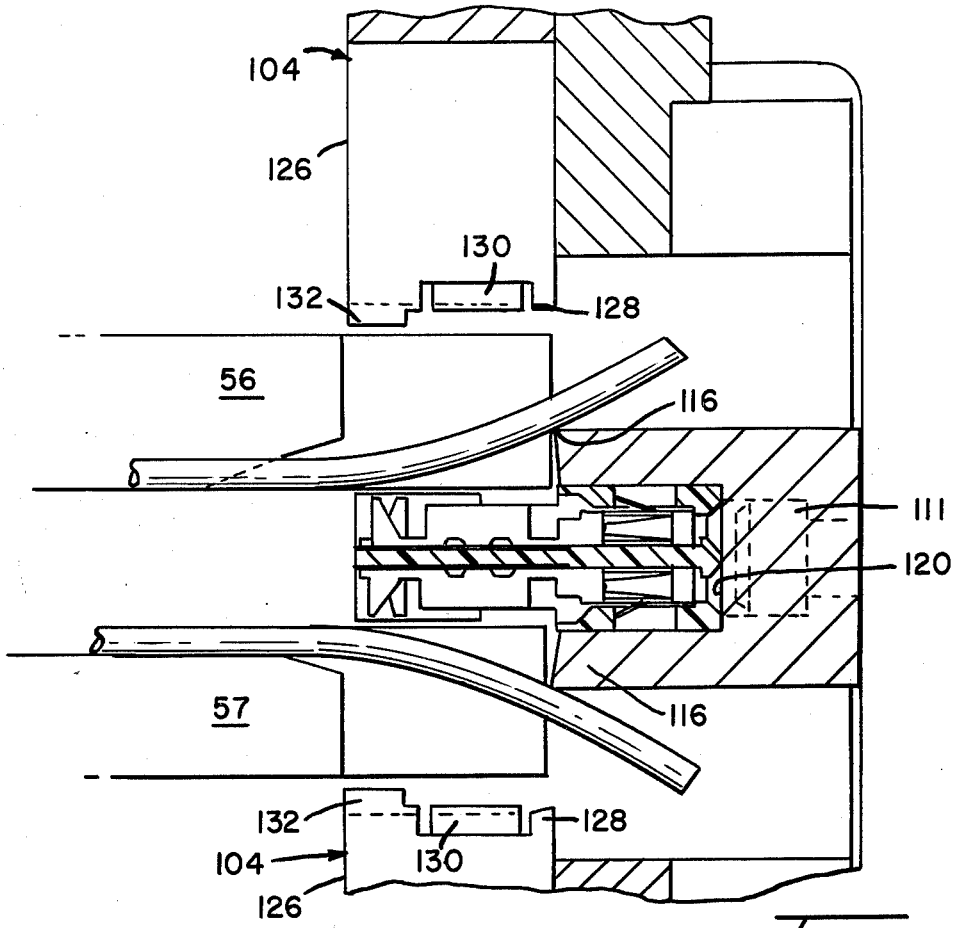
FIGS. 13 and 14 are sequential sections through the cutoff and terminating tooling.

Referring now to FIGS. 6, 12 and 13, the operation of comb members 60 and 62 spreads the conductors and forms the initial entry point for the finger 124. As shown in FIG. 12 the finger 124 of the connector holder conductor wiping fixture 110 is of the same or slighter greater height that the selected connector, the templates 56 and 57 have been spaced to just accept the finger 124 and thereby wipe the conductors into the groove 58 and 59 as the carriage plate 32 moves through the midsection 12 of cam track 8.

Figure 16:
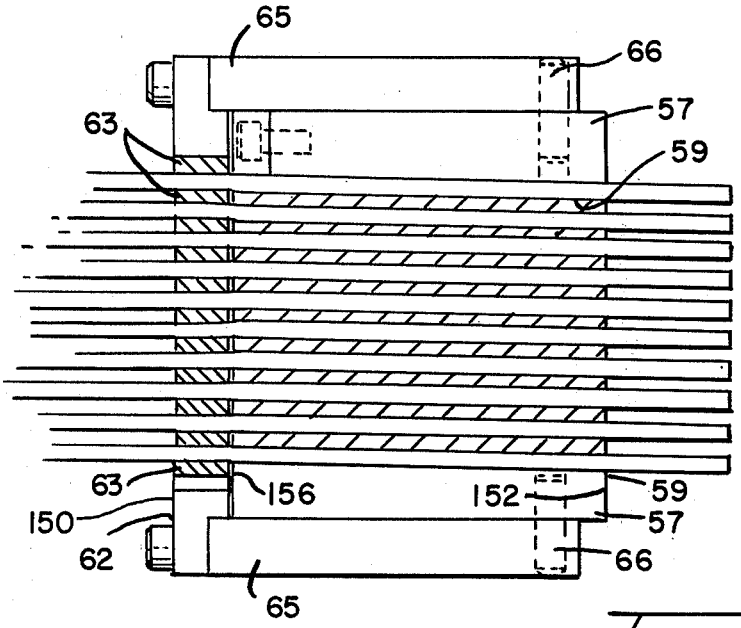
FIG. 16 is a section view taken along line 16—16 of FIG. 15.

Referring now to FIG. 16, the programming feature of template 57 is readily seen. As stated previously, the ribbon cable has a plurality of conductors in a single plane side-by-side arrangement and the desired configuration is two parallel planes of parallel conductors. Assuming a 0.050 centerline in the cable and a 0.100 centerline in the connector it is necessary to move the conductors over each other as well as to reposition the centerlines. This is accomplished in the preferred embodiment by having oppositely directed templates with a 0.025 divergence from entry centerline position to termination. Template 57 receives the conductors biased by teeth 61 of comb 60 into the voids between teeth 63 of comb 62. Thus at the lead edge 150 the grooves 59 are aligned with the teeth 61 of upper comb 60 and at the trailing edge 152 they are skewed 0.025 centerline alignment with the connector terminals.

Figure 14:
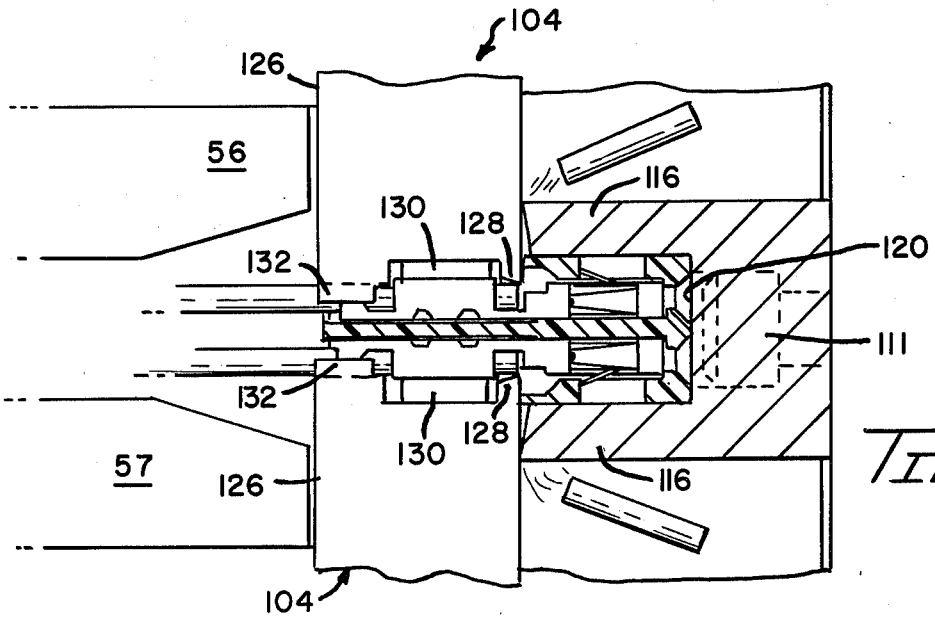
Figure 15:
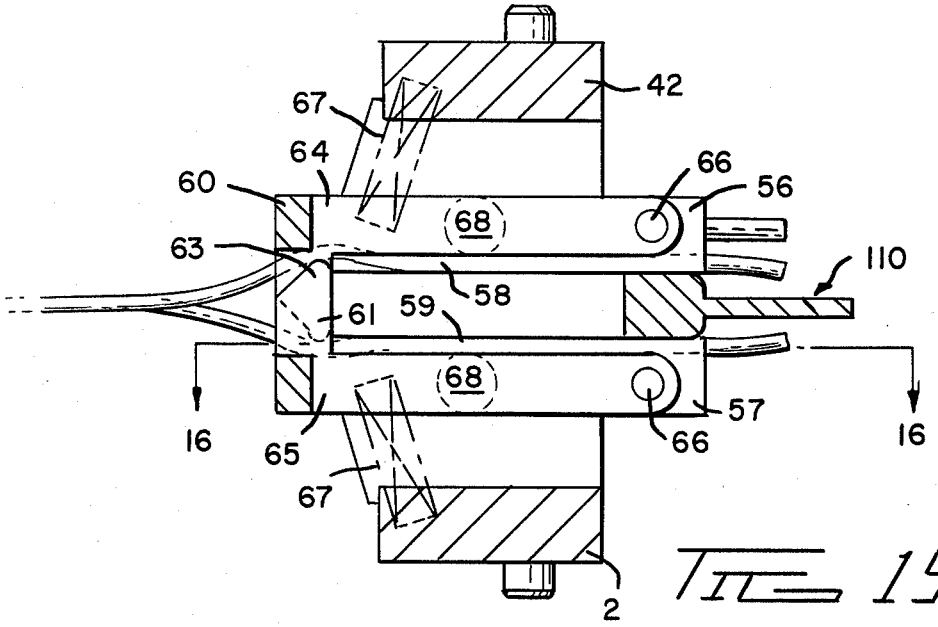
FIG. 15 is a section through the terminating tooling just prior to activating the cutting and terminating tool.

FIGS. 13 and 14 illustrate the termination action of the preferred embodiment. Note that the conductors have been moved over the cutter bars 116, the templates 56 and 57 are withdrawn enough to clear tooling 104 and the connector is positioned in connector channel 114 with the terminals directly under the conductors. In FIG. 14, cutting edges 128 and cutters bars 116 cooperate to shear the conductors and the conductors are stuffed and crimped by the remaining tool. Note that the conductors are pulled out of the grooves 58 and 59.

Although preferred embodiments of the present invention are disclosed and shown in detail, other modifications and embodiments which would be apparent to one having ordinary skill in the art, are intended to be covered by the spirit and scope of the claims.

What is claimed is:

1. An apparatus for terminating separated conductors at the free end of a multi-conductor ribbon cable, said apparatus comprising:

a conductor programming station having a pair of opposed comb members having a plurality of interdigitating teeth having means for engaging the conductors of said ribbon cable and driving adjacent conductors into two parallel spaced planes, alternate conductors being driven into the same plane;

a wiping and terminating station having means for receiving said conductors and effecting termination thereof with respective terminals of a connector.

2. An apparatus according to claim 1 wherein said programming station further comprises:

upper and lower templates, said interdigitating teeth driving said conductors into said upper and lower templates, means to draw said conductors through said templates to leave a measured length exposed.

3. An apparatus according to claim 2 further comprising:

a connector holding-conductor wiper fixture in said wiping and terminating station, said fixture having a conductor wiping finger with a tapered tip thereon to establish entry into the conductor programming station, said wiping finger having a flat mid-section profiled to pass closely to pass between said planes of conductors and guide them to appropriate sides of a connector held in said fixture whereby termination of the conductors in respective terminals can be effected.

4. An apparatus for terminating separated conductors at the free end of a ribbon cable to terminals in opposite sides of a connector, said apparatus comprising a conductor programming station having means for deflecting adjacent conductors of said cable in opposite directions from the plane of the cable, alternate conductors being deflected in the same direction;

connector positioning means movable relative to said programming station, said positioning means having means for holding said connector and positioning said connector between said oppositely deflected conductors subsequent to deflection at said programming station;

a terminating station movable relative to said programming station, said terminating station having means for terminating said conductors to said terminals in said connector subsequent to positioning said connector between said oppositely deflected conductors.

* * * * *